US007314382B2

(12) United States Patent
Nolan

(10) Patent No.: US 7,314,382 B2
(45) Date of Patent: Jan. 1, 2008

(54) APPARATUS AND METHODS OF MANUFACTURING AND ASSEMBLING MICROSCALE AND NANOSCALE COMPONENTS AND ASSEMBLIES

(75) Inventor: Michael Nolan, Richardson, TX (US)

(73) Assignee: Zyvex Labs, LLC, Richardson, TX (US)

( * ) Notice: Subject to any disclaimer, the term of this patent is extended or adjusted under 35 U.S.C. 154(b) by 360 days.

(21) Appl. No.: 11/131,760

(22) Filed: May 18, 2005

(65) Prior Publication Data

US 2006/0264086 A1 Nov. 23, 2006

(51) Int. Cl.
*H01R 13/627* (2006.01)

(52) U.S. Cl. ..... 439/353; 977/725

(58) Field of Classification Search ..... 335/78; 439/335; 977/725, 730

See application file for complete search history.

(56) References Cited

U.S. PATENT DOCUMENTS

| | | | |
|---|---|---|---|
| 3,268,774 | A | 8/1966 | Ortner |
| 3,439,416 | A | 4/1969 | Yando |
| 3,467,942 | A | 9/1969 | Dell et al. |
| 3,588,618 | A | 6/1971 | Otte |
| 4,018,409 | A | 4/1977 | Burch et al. |
| 4,141,138 | A | 2/1979 | Quick |
| 4,383,195 | A | 5/1983 | Kolm et al. |
| 4,740,410 | A | 4/1988 | Muller |
| 4,852,242 | A | 8/1989 | Tella et al. |
| 4,911,098 | A | 3/1990 | Tabata |
| 4,955,814 | A | 9/1990 | Christie et al. |
| 4,963,748 | A | 10/1990 | Szilagyi |
| 4,969,827 | A | 11/1990 | Hahs, Jr. |
| 5,025,346 | A | 6/1991 | Tang et al. |
| 5,072,288 | A | 12/1991 | MacDonald et al. |
| 5,092,781 | A | 3/1992 | Casciotti et al. |
| 5,113,117 | A | 5/1992 | Brooks et al. |
| 5,122,663 | A | 6/1992 | Chang et al. |
| 5,160,877 | A | 11/1992 | Fujiwara et al. |
| 5,215,923 | A | 6/1993 | Kinoshita et al. |
| 5,273,441 | A | 12/1993 | Volz et al. |
| 5,399,415 | A | 3/1995 | Chen et al. |
| 5,411,400 | A | 5/1995 | Subrahmanyan et al. |
| 5,538,305 | A | 7/1996 | Conway et al. |

(Continued)

FOREIGN PATENT DOCUMENTS

| | | |
|---|---|---|
| DE | 19746585 | 4/1999 |

(Continued)

OTHER PUBLICATIONS

Arai et al., "A New Pick Up & Release Method By Micromanipulation," IEEE, Jan. 1997.

(Continued)

*Primary Examiner*—Ross Gushi
(74) *Attorney, Agent, or Firm*—Haynes and Boone, LLP

(57) ABSTRACT

An apparatus including a positioner that is transitional from a first positioner orientation towards a second positioner orientation and that comprises a bistable member having a first substantially stable state corresponding to the first positioner orientation and a second substantially stable state corresponding to the second positioner orientation. The apparatus also includes a coupler that is transitional from a first coupler orientation towards a second coupler orientation in response to transition of the bistable-member.

23 Claims, 8 Drawing Sheets

U.S. PATENT DOCUMENTS

| | | | | |
|---|---|---|---|---|
| 5,539,200 | A | 7/1996 | Lebby et al. | |
| 5,610,335 | A | 3/1997 | Shaw et al. | |
| 5,645,684 | A | 7/1997 | Keller | |
| 5,657,516 | A | 8/1997 | Berg et al. | |
| 5,660,680 | A | 8/1997 | Keller | |
| 5,746,621 | A * | 5/1998 | Cronin | 439/507 |
| 5,774,956 | A | 7/1998 | French et al. | |
| 5,806,152 | A | 9/1998 | Saitou | |
| 5,818,748 | A | 10/1998 | Bertin | |
| 5,848,456 | A | 12/1998 | Sjoqvist | |
| 5,867,302 | A | 2/1999 | Flemming | |
| 5,895,084 | A | 4/1999 | Mauro | |
| 5,963,788 | A | 10/1999 | Barron et al. | |
| 6,103,399 | A | 8/2000 | Smela et al. | |
| 6,131,277 | A | 10/2000 | Cadenhead et al. | |
| 6,154,936 | A | 12/2000 | Howell et al. | |
| 6,193,139 | B1 | 2/2001 | Kivilahti | |
| 6,193,541 | B1 | 2/2001 | Lee | |
| 6,215,081 | B1 | 4/2001 | Jensen et al. | |
| 6,218,664 | B1 | 4/2001 | Krans et al. | |
| 6,219,254 | B1 | 4/2001 | Ackerling et al. | |
| 6,239,685 | B1 | 5/2001 | Albrecht et al. | |
| 6,257,925 | B1 | 7/2001 | Jones | |
| 6,263,549 | B1 | 7/2001 | Uehara | |
| 6,300,156 | B1 | 10/2001 | Decker et al. | |
| 6,303,885 | B1 | 10/2001 | Hichwa et al. | |
| 6,321,654 | B1 | 11/2001 | Robinson | |
| 6,396,711 | B1 | 5/2002 | Degani et al. | |
| 6,398,280 | B1 | 6/2002 | Parker et al. | |
| 6,429,113 | B1 | 8/2002 | Lewis et al. | |
| 6,483,419 | B1 | 11/2002 | Weaver et al. | |
| 6,488,315 | B1 | 12/2002 | Brenner et al. | |
| 6,531,947 | B1 | 3/2003 | Weaver et al. | |
| 6,561,725 | B1 | 5/2003 | Ellis et al. | |
| 6,617,522 | B2 | 9/2003 | Tabacutu | |
| 6,672,795 | B1 | 1/2004 | Ellis et al. | |
| 6,678,458 | B2 | 1/2004 | Ellis | |
| 6,679,055 | B1 | 1/2004 | Ellis | |
| 6,691,513 | B1 | 2/2004 | Kolesar | |
| 6,745,567 | B1 | 6/2004 | Mercanzini | |
| 6,762,116 | B1 | 7/2004 | Skidmore | |
| 6,764,325 | B2 | 7/2004 | Arrigotti et al. | |
| 6,837,723 | B1 | 1/2005 | Randall et al. | |
| 6,862,921 | B2 | 3/2005 | Chand et al. | |
| 6,881,074 | B1 | 4/2005 | McLenaghan | |
| 6,923,669 | B1 | 8/2005 | Tsui et al. | |
| 6,956,219 | B2 * | 10/2005 | Saini et al. | 250/398 |
| 6,982,515 | B2 * | 1/2006 | Howell et al. | 310/307 |
| 7,012,491 | B1 * | 3/2006 | Geisberger et al. | 335/78 |
| 7,075,209 | B2 * | 7/2006 | Howell et al. | 310/309 |
| 7,081,630 | B2 * | 7/2006 | Saini et al. | 250/398 |
| 2001/0010348 | A1 | 8/2001 | Bilanin et al. | |
| 2002/0125208 | A1 | 9/2002 | Christenson et al. | |
| 2003/0201654 | A1 | 10/2003 | Ellis | |
| 2003/0210115 | A1 | 11/2003 | Kubby et al. | |
| 2004/0135526 | A1 | 7/2004 | Winkler et al. | |
| 2007/0138888 | A1 * | 6/2007 | Pinkerton et al. | 310/152 |

FOREIGN PATENT DOCUMENTS

| | | |
|---|---|---|
| EP | 0490530 | 6/1992 |
| EP | 0497620 | 8/1992 |
| JP | 57161819 | 10/1982 |
| JP | 05166973 | 7/1993 |
| JP | 06061691 | 3/1994 |
| WO | WO 9713981 | 4/1997 |

OTHER PUBLICATIONS

Capanu et al., "Design, Fabrication, and Testing of a Bistable Electromagnetically Actuated Microvalve", Journal of Microelectromechinical Systems, vol. 9, No. 2, Jun. 2000, pp. 181-188.

Cohn et al., "Microassembly Technologies for MEMS", University of California at Berkley and University of Washington.

Cohn et al., "Self-Assembling Electrical Networks: An Application of Micromachining Technology", May 1991.

Comtois et al. "Applications for surface-micromachined polysilicon thermal actuators and arrays," Sensors and Actuators A58, 1997, pp. 19-25.

Comtois et al. "Electrothermal actuators fabricated in four-level planarized surface micromachined polycrystalline silicon," Sensors and Actuators A70, 1998, pp. 23-31.

Comtois et al., "Thermal Microactuators for surface-micromachining processes," SPIE vol. 2642, 1995, pp. 10-21.

Dechev et al., "Microassembly of 3-D Microstructure Using a Compliant, Passive Microgripper," Journal of Microelectromechanical Systems, vol. 13, No. 2, Apr. 2004, pp. 176-189.

Ellis, et al., "High aspect ratio silicon micromechanical connectors", High Aspect Ratio Micro-Structure Technology Workshop, Monterey, California, Jun. 15-17, 2003.

Fearing, "Survey of Sticking Effects for Micro Parts Handling", IEEE, Apr. 1995.

Gomm et al., "In-Plane Linear Displacement Bistable Microrelay", 2002 IOP Publishing Ltd., UK, pp. 257-264.

Gracias et al., "Forming Electrical Networks in Three Dimensions by Self-Assembly", Science, vol. 289, Aug. 18, 2000, pp. 1170-1172.

Handbook of Industrial Robotics, Shimon Y. Nof, Editor, Chapter 26 and Section 4.1.4., pp. 478-479.

Handbook of Industrial Robotics, Shimon Y. Nof, Editor, Second Edition, 1999, Chapter 5, pp. 43-78.

Harsh et al., "Flip-Chip Assembly for Si-Based RF MEMS", NSF Center for Advanced Manufacturing and Packaging of Microwave, Optical and Digital Electronics, Department of Mechanical Engineering, University of Colorado.

Harsh et al., "Solder Self-Assembly for MEMS", NSF Center for Advanced Manufacturing and Packaging of Microwave, Optical and Digital Electronics, Department of Mechanical Engineering, University of Colorado.

Hitakawa, "Advanced Parts Orientation System Has Wide Application", Aug. 1988.

IBM Technical Disclosure Bulletin, "Chip-to-Chip Cable Connection," IBM Corp., vol. 27, No. 11, Apr. 1985, pp. 6761-6763.

International Preliminary Examination Report in PCT/US01/015011 dated Sep. 13, 2002.

International Preliminary Examination Report in PCT/US01/15059 dated Aug. 2, 2002.

International Preliminary Examination Report in PCT/US01/24173 dated Jan. 17, 2003.

International Search Report in PCT/US01/015011 dated Dec. 3, 2001.

International Search Report in PCT/US01/15059 dated Dec. 12, 2001.

Jensen et al., "Design Optimization of a Fully-Compliant Bistable Micro-Mechanism", Proceedings of 2001 ASME International Mech. Eng. Congress and Expo., New York, Nov. 2001, pp. 1-7.

Keller et al., "Hexsil Tweezers for Teleoperated Microassembly", IEEE Micro Electro Mechanical Systems Workshop, 1997, pp. 72-77.

Keller, Microfabricated High Aspect Ratio Silicon Flexures, 1998.

Kruglick et al., "Bistable MEMS Relays and Contact Characterization", University of California Berkeley Sensors and Actuators Center, pp. 1-5.

Maekoba et al., "Self-Aligned Vertical Mirror and V-Grooves Applied to an Optical-Switch: Modeling and Optimization of Bistable Operation by Electromagnetic Actuation", Sensors and Actuators A 87, 2001, pp. 172.178.
Mohr, "LIGA-A Technology for Fabricating Microstructures and Microsystems," Sensors and Materials, vol. 10, No. 6, 1998, pp. 363-373.
Muray et al., "Advances in Arrayed Microcolumn Lithography", Journal of Vacuum Science and Technology. B, Microelectronics and Nanometer Structures Processing, Measurement and Phenomena: An Official Publication of the American Vacuum Society, vol. 18 (6), Nov./Dec. 2000, pp. 3099-3104. (IRN10495228).
Prasad et al., "Design, Fabrication, and Characterization of Single Crystal Silicon Latching Snap Fasteners for Micro Assembly", Proc. ASME Int.Mech.Eng. Congress and Expo. (IMECE'95), San Francisco, CA, Nov. 1995.
Qiu et al., "A Centrally-Clamped Parallel-Beam Bistable MEMS Mechanism", IEEE 2001, pp. 353-356.
Schreiber et al., "Surface Micromachined Electrothermal V-Beam Micromotors", Proc of 2001 ASME International Mechanical Engineering Congress and Exp., Nov. 11, 2001.
Search Report in PCT/US01/24173 dated May 17, 2002.
Szilagyi et al., "Synthesis of Electrostatic Focusing and Deflection Systems," JVST B, 15(6), Nov./Dec. 1997, p. 1971.
Taher et al., "On a Tunable Bistable MEMS- Theory and Experiment", Journal of Microelectromechanical Systems, vol. 9, No. 2, Jun. 2000, pp. 157-170.
Tsui et al., "Micromachined end-effector and techniques for directed MEMS assembly," Journal of Micromechanics and Microengineering, Institute of Physics Publishing, United Kingdom, 2004, pp. 1-8.
Yeh et al., "Fluidic Self-Assembly of Microstructures and its Application to the Integration of GaAs on Si", IEEE, Jan. 1994, pp. 279-284.
Yeh et al., "Single Mark , Large Force, and Large Displacement Electrostatic Linear Inchwork Motors," Berkley Sensor and Actuator Center, Department of Electrical Engineering and Computer Science, University of California, Berkley.
Yeh et al., "Surface-Micromachined Components for Articulated Microrobots" Journal of Microelectromechanical Systems, vol. 5, No. 1, Mar. 1996.

* cited by examiner

APPARATUS AND METHODS OF MANUFACTURING AND ASSEMBLING MICROSCALE AND NANOSCALE COMPONENTS AND ASSEMBLIES

This invention was made with the United States Government support under 70NANB1H3021 awarded by the National Institute of Standards and Technology (NIST). The United States Government has certain rights in the invention.

CROSS-REFERENCE TO RELATED APPLICATIONS

This application is related to commonly-assigned U.S. patent application Ser. No. 10/778,460, entitled "MEMS MICROCONNECTORS AND NON-POWERED MICROASSEMBLY THEREWITH," filed on Feb. 13, 2004, the entirety of which is hereby incorporated by reference herein.

This application is also related to commonly-assigned U.S. patent application Ser. No. 11/074,448, entitled "SOCKETS FOR MICROASSEMBLY," filed on Mar. 8, 2005, the entirety of which is hereby incorporated by reference herein.

BACKGROUND

Extraordinary advances are being made in micromechanical devices and microelectronic devices, including microelectro-mechanical devices (MEMs), which comprise integrated micromechanical and microelectronic devices. The terms "microcomponent," "microconnector," "microdevice," and "microassembly" are used herein generically to encompass microelectronic components, micromechanical components, MEMs components and assemblies thereof.

Many methods and structures exist for coupling MEMs and other microcomponents together to form a microassembly. One such method, often referred to as "pick-and-place" assembly, is serial microassembly, wherein microcomponents are assembled one at a time in a serial fashion. For example, if a device is formed by coupling two microcomponents together, a gripper or other placing mechanism is used to pick up one of the two microcomponents and place it on a desired location of the other microcomponent. These pick-and-place processes, although seemingly quite simple, can present obstacles affecting assembly time, throughput and reliability.

For example, pick-and-place processes often employ powered "grippers" having end effectors configured to expand and/or contract in response to energy received from an integral or external power source. However, structural fragility, increased packaging complexity and uncertainties due to variations in actuator displacements limit the practical usefulness of employing such powered grippers during microassembly.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
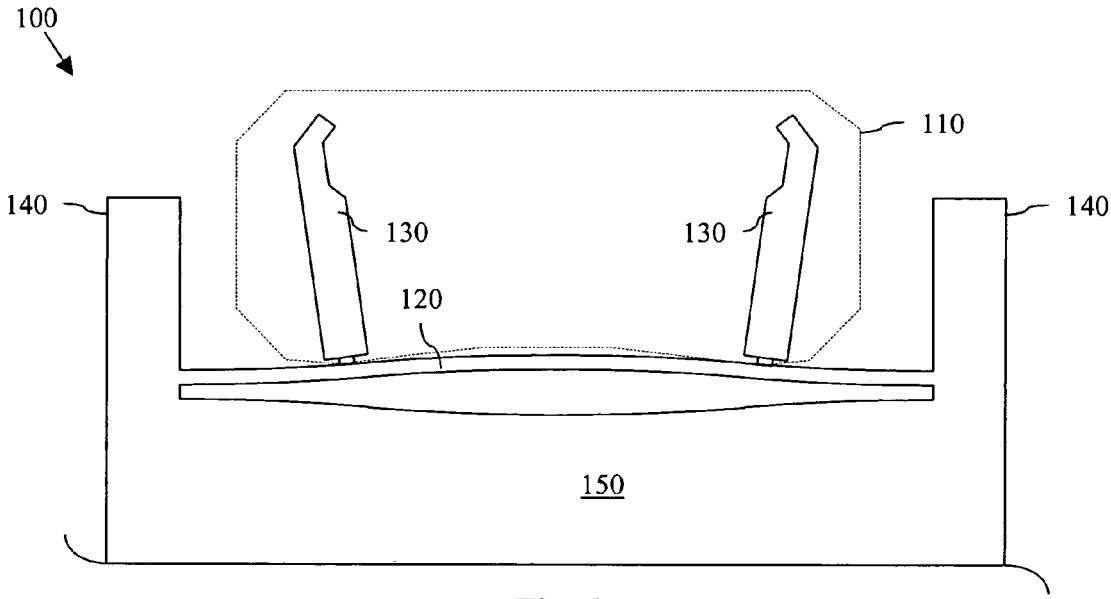
FIG. 1 is a schematic view of at least a portion of one embodiment of apparatus according to aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Figure 2:
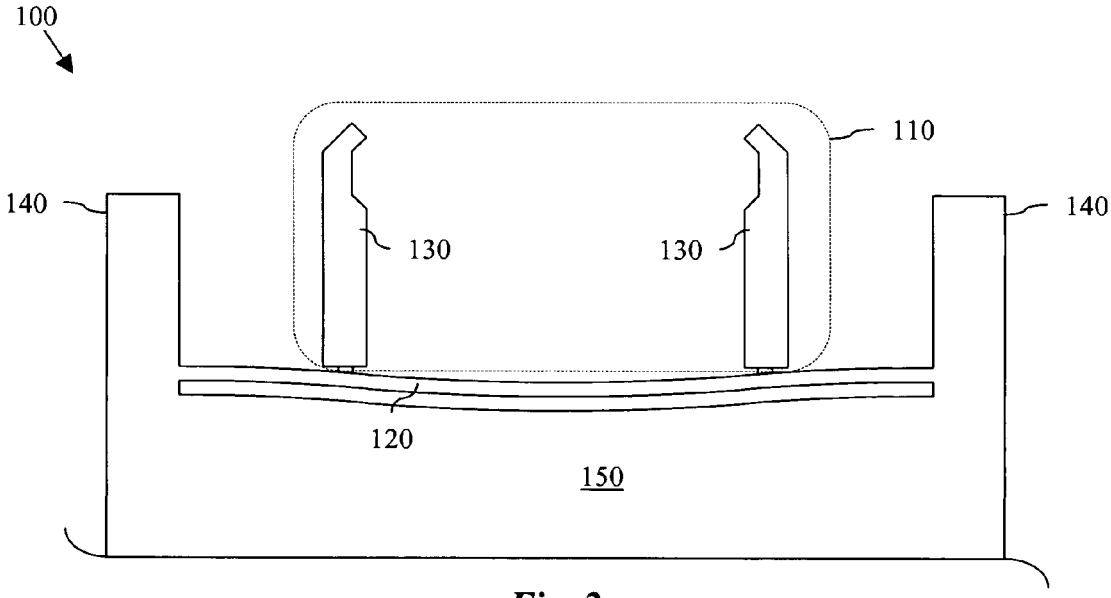
FIG. 2 is a schematic view of another orientation of at least a portion of the apparatus shown in FIG. 1.

Referring to FIGS. 1 and 2, collectively, illustrated are schematic views of at least a portion of one embodiment of an apparatus 100 according to aspects of the present disclosure. The apparatus 100 is depicted in a first orientation in FIG. 1 and in a second orientation in FIG. 2. In one embodiment, the first orientation of FIG. 1 is a disengaged orientation, and the second orientation of FIG. 2 is an engaged orientation.

The apparatus 100 may be a microcomponent and, therefore, have at least one feature dimension not greater than about 1000 microns, such as a microelectromechanical (MEMS) component. The apparatus 100 may also be a nanocomponent and, therefore, have at least one feature dimension not greater than about 10 microns, such as a nanoelectromechanical (NEMS) component. Of course, components of other scales and feature dimensions are also within the scope of the present disclosure. Nonetheless, continuing with this convention, the apparatus 100 may be a component of a microassembly including at least one component having at least one feature dimension not greater than about 1000 microns, and/or a component of a nanoassembly including at least one component having at least one dimension not greater than about 10 microns.

The apparatus 100 includes a coupler 110 and a positioner 120, among other possible features and/or elements. The coupler 110 may be directly or indirectly coupled or otherwise connected with the positioner 120, such as in embodiments in which the coupler 110 and the positioner 120 are unitarily formed from the same layer or layers of a substrate, including embodiments in which a portion of such layer(s) interposes the coupler 110 and the positioner 120. The coupler 110 is configured to couple the apparatus 100 with another MEMS, NEMS or similar component based on an orientation of the positioner 110. For the sake of simplicity, subsequent reference to a "microcomponent" herein may refer to a MEMS, NEMS, or other component of similar dimensional scale.

The positioner 120 can transition between different orientations, such as the first orientation depicted in FIG. 1 and the second orientation depicted in FIG. 2. Alternative and additional orientations are also within the scope of the present disclosure. However, one or more of the orientations of the positioner 120, possibly including those depicted in FIGS. 1 and 2, may correspond to a substantially stable state of the positioner 120. For example, the positioner 120 may be or comprise a bistable member having two stable states, such as in the illustrated embodiment in which the positioner 120 is substantially a bistable member. In such embodiments, the positioner 120 may be configured to transition from a first positioner orientation towards a second positioner orientation, and the first and second positioner orientations may each correspond to a respective one of the two stable states of the bistable member.

The coupler 110 can also transition between different orientations. For example, a first orientation of the coupler 110 is depicted in FIG. 1 and a second orientation of the coupler 110 is depicted in FIG. 2. Alternative and additional orientations are also within the scope of the present disclosure. However, one or more of the orientations of the coupler 110, possibly including those depicted in FIGS. 1 and 2, may correspond to one or more of the stable states of the positioner 120 described above. For example, as will be described more fully below, the coupler 110 may be configured to transition from a first coupler orientation towards a second coupler orientation, the first and second coupler orientations each corresponding to a respective one of the two stable states of the positioner 120. Thus, it follows from the above description that the first and second orientations of the coupler 110 shown in FIGS. 1 and 2 may also each correspond to an engaged orientation or a disengaged orientation of the coupler 110.

In one embodiment, the orientation of the coupler 110 and the positioner 120 shown in FIG. 1 may be substantially similar to an initial orientation thereof. For example, the orientation depicted in FIG. 1 may substantially resemble a design, pattern or layout of the coupler 110 and the positioner 120 as defined from one or more silicon or other layers of a substrate. Alternatively, or additionally, the orientation of FIG. 1 may substantially resemble a design, pattern or layout of the coupler 110 and the positioner 120 after their partial or complete release from such a substrate.

Thereafter, the positioner 120 may be transitioned from the orientation of FIG. 1 to or towards the orientation of FIG. 2. The force employed for such transition may be exerted in response to physical contact with another component, such as a corresponding receptacle or socket, a microscale probe, and/or other microscale apparatus. In embodiments in which the positioner 120 comprises a bistable or multistable member having two or more substantially stable states, the force employed to transition the positioner 120 to a different orientation may be that force which is necessary to transition the positioner 120 out of one such stable state.

For example, if the orientation of the positioner 120 shown in FIG. 1 corresponds to a stable state of the positioner 120, the force employed to transition the positioner towards another orientation (such as towards the orientation of FIG. 2) may be about equal to or greater than the force necessary to transition the positioner 120 out of the stable state.

In one embodiment, the positioner 120 is a bistable member coupled to two opposing legs 140 of the apparatus 100 and spanning a separation distance between the legs 140, as in FIGS. 1 and 2. Thus, the ends of the bistable member are positionally anchored relative to each other, although anchoring means other than the legs 140 may also be employed within the scope of the present disclosure. Nonetheless, the bistable member has a length that is slightly greater than the separation distance between anchored ends (i.e., the legs 140). Consequently, the bistable member of the positioner 120 may have two substantially stable states in which the bistable member is bowed towards or away from a body portion 150 of the apparatus. For example, the orientation of the positioner 120 shown in FIG. 1 may correspond to a first stable state of such a bistable member, and the orientation of the positioner 120 shown in FIG. 2 may correspond to a second stable state of such a bistable member. Consequently, a force exerted on the positioner 120 for transition away from the first stable state of the orientation shown in FIG. 1 may be about equal to or greater than the force necessary to transition the bistable member of the positioner 120 out of the stable state shown in FIG. 1.

Moreover, at least in embodiments in which the positioner 120 comprises such a bistable member, as the bistable member transitions out of one stable state, the bistable member may automatically assume a second stable state. For example, once the bistable member transitions to or past a midpoint between its stable states, the bistable member may automatically complete transition to the second stable state, at least in the absence of some other external force or object preventing such transition. Thus, where the positioner 120 substantially comprises a bistable member, transition of the positioner 120 to or past a midpoint between the stable states of the bistable member may cause the positioner 120 to automatically assume a second orientation corresponding to the second stable state.

The coupler 110 can include a number of coupler members 130, such as the two members 130 shown in FIGS. 1 and 2. One or more orientations of the coupler members 130 may correspond to one or more orientations of the positioner 120 and/or one or more stable states of the positioner 120. One such orientation, which may be substantially similar to the orientation shown in FIG. 2, may be an engaged orientation relative to a corresponding socket or receptacle configured to engage with the coupler 110. Another orientation of the coupler members 130, which may be substantially similar to the orientation shown in FIG. 1, may correspond to another positioner orientation and/or another stable state of the positioner 120, and may be a disengaged orientation relative to a corresponding socket or receptacle.

Figure 3:
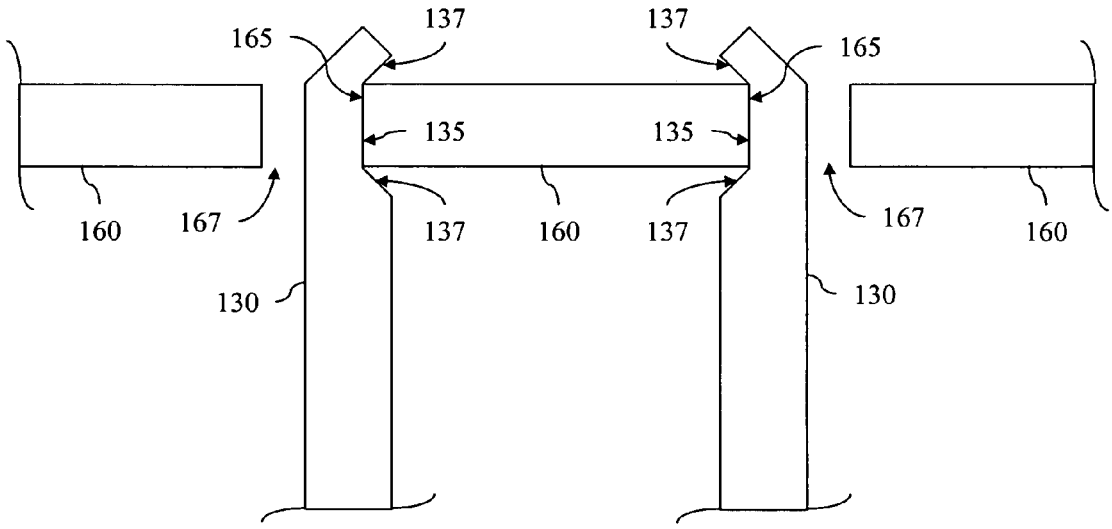
FIG. 3 is a schematic view of one embodiment of a portion of the apparatus shown in FIGS. 1 and 2.

Referring to FIG. 3, illustrated is a schematic view of a portion of the coupler members 130 shown in FIGS. 1 and 2. The coupler members 130 may have an inner profile 135 configured to cooperate or otherwise correspond to a portion of another component 160 configured to engage with the coupler members 130, such as the corresponding socket or receptacle described above. For example, at least a portion of the inner profile 135 may substantially conform to at least a portion of an outer profile 165 of the component 160. In the illustrated embodiment, these substantially conforming profiles 135, 165 are each substantially planar, such as may be achieved via conventional etching processes, among other methods. However, the scope of the present disclosure is not limited to such an embodiment.

The coupler members 130 of the illustrated embodiment also include portions 137 which may be configured to guide or align the first and second profiles 135, 165. These guiding or alignment portions 137 may be substantially planar, as in the illustrated embodiment, although other embodiments may include portions 137 of other shapes. Alternatively, or additionally, the guide/alignment portions 137 may be integral to the component 160, as opposed to being integral to the coupler members 130 as in the illustrated embodiment.

Although not illustrated as such in FIG. 3, one embodiment of the coupler members 130 may include a guide/alignment portion 137 or other portion of the tip of the coupler member 130 which, when the coupler member 130 is engaged with the component 160, includes a surface or other feature which contacts a rear surface (e.g., towards the top of the page in FIG. 3) of the component 160, or a feature of such rear surface. Such contact may include electrical contact, including in embodiments in which the coupler member 130 and/or the component 160 includes conductive areas or portions configured to encourage such electrical contact, as in embodiments described below. Thus, for example, the tip of one or more coupler members 130 may wrap around the profile of the component 160, such that the tip conforms to a surface or feature of the component 160 other than or in addition to the sidewall 165 of an aperture 167 in the component 160.

Thus, in such embodiments and others, each coupler member 130 may be configured to extend into the aperture 167 of the component 160. For example, each coupler member 130 may be configured to extend completely through the aperture 167, as in the illustrated embodiment, or to merely extend into the aperture 167 but not past a rear surface of the component 160, such as where the aperture may be a cavity or recess, as opposed to a through-hole. Each aperture 167 may be sized to allow passage of a coupler member 130 when one or each coupler member 130 is in a disengaged orientation.

Figure 4:
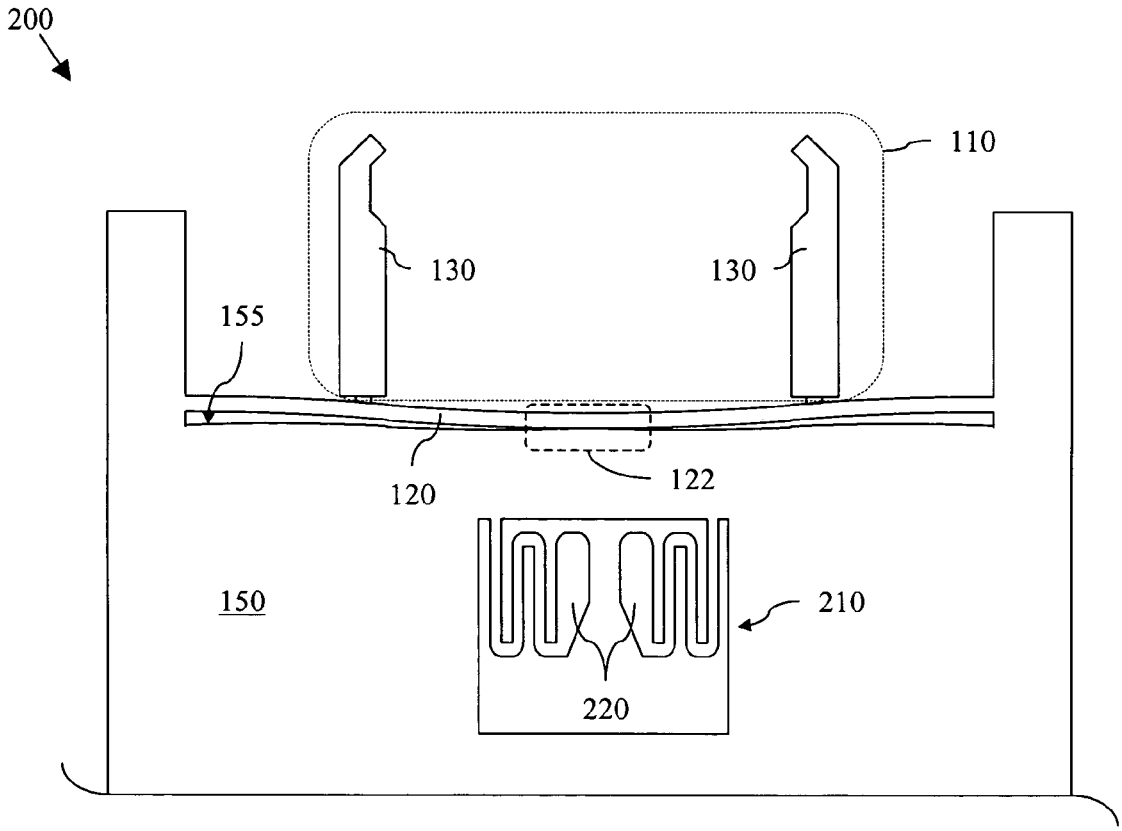
FIG. 4 is a schematic view of at least a portion of another embodiment of the apparatus shown in FIGS. 1 and 2.

Referring to FIG. 4, illustrated is a schematic view of at least a portion of another embodiment of the apparatus 100 shown in FIGS. 1 and 2, designated herein by reference numeral 200. The apparatus 200 is substantially similar to the apparatus 100 of FIGS. 1 and 2. However, the apparatus 200 demonstrates that, at least where the positioner 120 is substantially a bistable member, the positioner 120 may be prevented from transitioning completely to a second stable state of the bistable member. That is, the positioner 120 of the apparatus 200 is prevented from reaching its second stable state by interference with a surface 155 of the body portion 150 of the apparatus 100 (e.g., proximate a center portion 122 of the positioner). Nonetheless, the orientation of the positioner 120 (and, hence, the coupler 110 attached to the positioner) shown in FIG. 4 may also be a substantially stable orientation, as the stress in the positioner 120 prevents it from moving in a first direction away from the body 150 of the apparatus 200 (in the absence of some external force), and the contact between the positioner 120 and the body 150 prevents any further movement of the position in a second, opposite direction. In other similar embodiments, some object other than the surface 155 of the body portion 150 may prevent the positioner 120 from fully reaching its "natural" second stable state.

The embodiment shown in FIG. 4 also demonstrates that the apparatus 200 may include at least one manipulation interface 210. In fact, many other apparatus within the scope of the present disclosure, including the apparatus 100 shown in FIGS. 1 and 2, may include one or more manipulation interfaces 210. The manipulation interface 210 may be substantially similar to a compliant handle configured for frictional engagement with a manipulation probe, such as those described in commonly-assigned U.S. patent application Ser. No. 10/778,460, entitled "MEMS MICROCONNECTORS AND NON-POWERED MICROASSEMBLY THEREWITH," and Ser. No. 11/074,448, entitled "SOCKETS FOR MICROASSEMBLY."

In general, the manipulation interface 210 may include one or more flexible members 220 configured to deflect in response to contact with a manipulation probe, gripper or other microscale probe or apparatus employed to orient the apparatus 200, such as during engagement of the apparatus 200 and a corresponding socket or receptacle (e.g., the component 160 shown in FIG. 3). The manipulation interface 210 is configured to frictionally engage or "grip" such a manipulation probe during orientation of the apparatus 200, and thereafter release the probe without damaging the interface 210 or other portion of the apparatus 200. As shown in FIG. 4, each manipulation interface 210 may comprise two of the flexible members 220, although some embodiments of the interface 210 may only include one flexible member 220, while other embodiments may include more than two flexible members 220.

Figure 5:
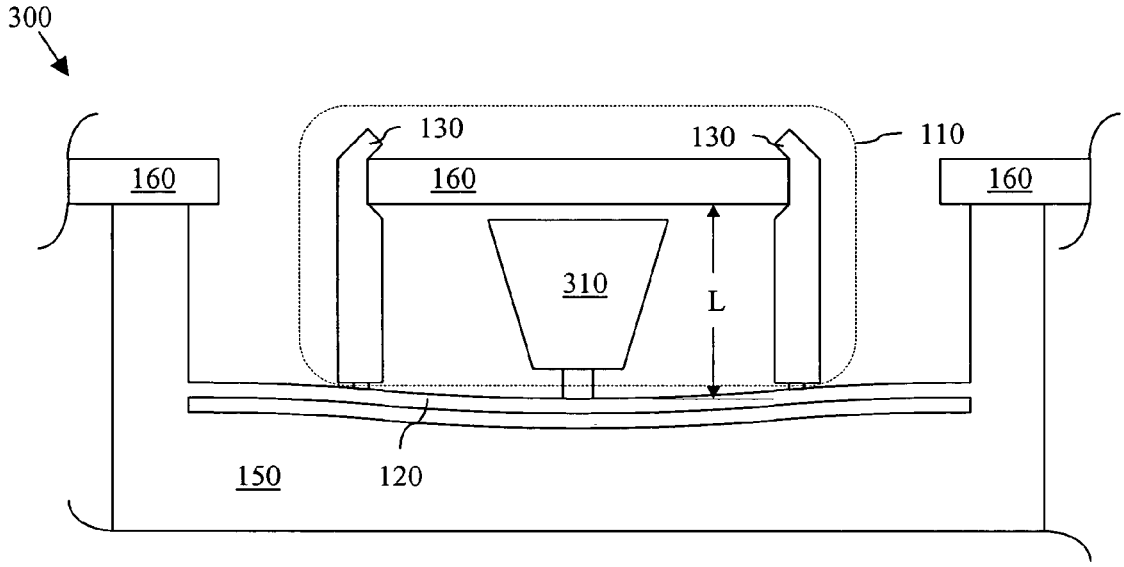
FIG. 5 is a schematic view of at least a portion of another embodiment of the apparatus shown in FIGS. 1 and 2.

Referring to FIG. 5, illustrated is a schematic view of at least a portion of another embodiment of the apparatus 100 shown in FIGS. 1 and 2, herein designated by reference numeral 300. The apparatus 300 may be substantially similar to the apparatus 100 of FIGS. 1 and 2 and/or the apparatus 200 of FIG. 4. However, the apparatus 300 also includes at least one transitioner 310. Of course, other apparatus within the scope of the present disclosure may also include at least one transitioner 310, including the apparatus 100 of FIGS. 1 and 2 and the apparatus 200 of FIG. 4.

The transitioner 310 is configured to contact the socket, receptacle or other component 160 to which the apparatus 300 will be assembled. Consequently, as the apparatus 300 is translated towards the component 160, the transitioner 310 may transition the positioner 120 from a first positioner orientation towards a second positioner orientation. The shape of the transitioner 310 is not limited by the scope of the present disclosure, and the particular shape of the transitioner 310 in the embodiment illustrated in FIG. 5 is merely one example. The transitioner 310 may be unitarily formed with the coupler 110 and/or the positioner 120, such as from the same layer(s) of a substrate, thereafter being partially or completely released from the substrate.

The length L to which the transitioner 310 extends away from its junction or intersection with the positioner 120 may vary among embodiments within the scope of the present disclosure. In some embodiments, the length L may be configured such that the transitioner 310 and the component 160 remain in contact even after the apparatus 300 and the component 160 are engaged. In other embodiments, however, such contact need not be maintained. For example, the length L of the transitioner 310 may only be sufficient to transition the positioner 120 out of the first positioner orientation. Thus, in some embodiments, the contact between the transitioner 310 and the component 160 may not be necessary once the positioner 120 has been sufficiently transitioned away from its first orientation to, for example, at least a midpoint between two of the stable states of the positioner 120. Nonetheless, other embodiments may employ a transitioner 310 having a length L configured such that contact with the component 160 is maintained at all times, such as may increase the rigidity, robustness and/or alignment accuracy of the assembly of the apparatus 300 and component 160.

Figure 6:
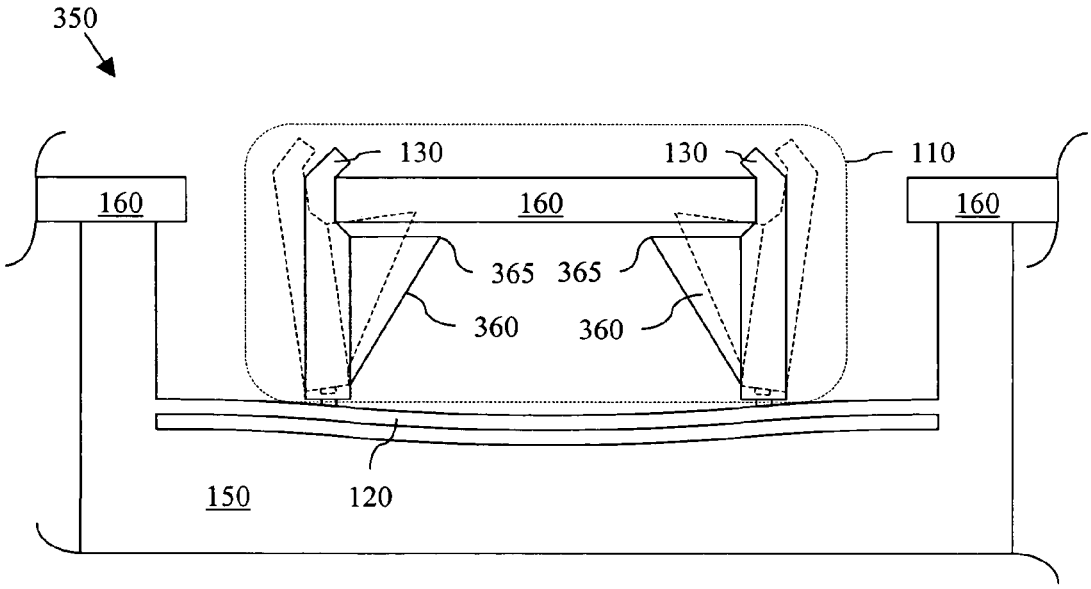
FIG. 6 is a schematic view of at least a portion of another embodiment of the apparatus shown in FIG. 6.

Referring to FIG. 6, illustrated is a schematic view of at least a portion of another embodiment of the apparatus 300 shown in FIG. 5, herein designated by the reference number 350. The apparatus 350 is substantially similar to the apparatus 300 shown in FIG. 5. However, the apparatus 350 includes another embodiment of the transitioner 310 shown in FIG. 5, herein designated by reference numeral 360, which may be employed in addition to the transitioner 310 of FIG. 5, or as an alternative to the transitioner 310. The transitioner 360 may be unitarily formed with the coupler members 130 or other portion of the coupler 110. In general, the shape of the transitioner 360 is configured for substantially the same function as the transitioner 310 of FIG. 5, possibly having substantially the same result.

Thus, in the illustrated example, a disengaged orientation of the coupler members 130 and transitioners 360 are depicted with dashed lines, and an engaged orientation of the coupler members 130 and transitioners 360 are depicted with solid lines (only the engaged orientation of the positioner 120 is shown in FIG. 6). As the apparatus 350 is translated towards the component 160, the tips 365 of the transitioners 360 will initially contact the component 160. Continued translation of the apparatus 350 towards the component 160 will cause the transition of the coupler members 130 towards a second orientation, where such transition may include translation towards a body portion 150 of the apparatus 350 and/or rotation relative to the body portion 150. In response to the transition of the coupler members 130, the positioner 120 will transition towards a second orientation. Ultimately, the positioner 120 will sufficiently transition from its initial orientation such that the coupler members 130 and the component 160 will engage, thus assembling the apparatus 350 and the component 160.

Figure 7:
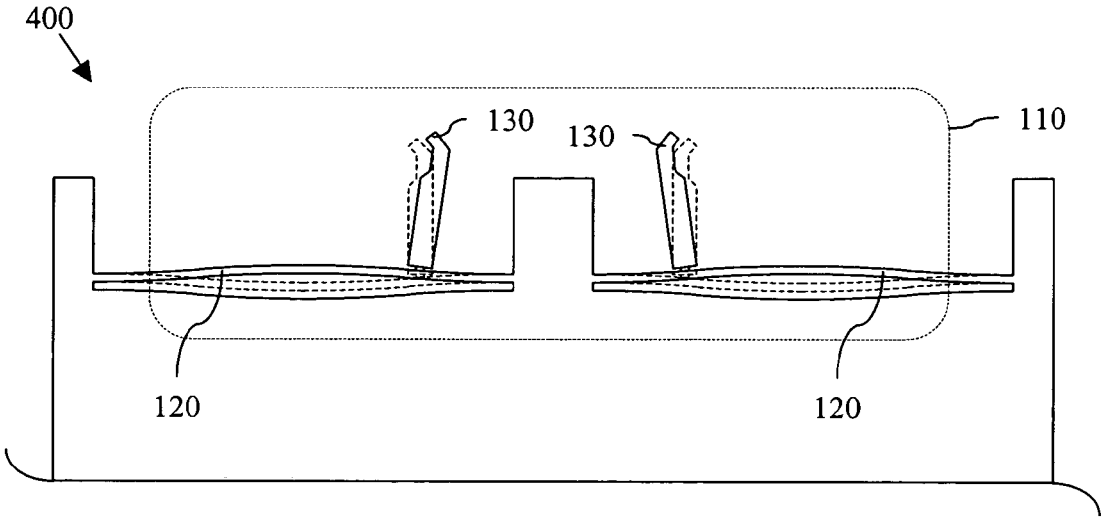
FIG. 7 is a schematic view of at least a portion of another embodiment of the apparatus shown in FIGS. 1 and 2.

Referring to FIG. 7, illustrated is a schematic view of at least a portion of another embodiment of the apparatus 100, 200, 300 and 350 shown in FIGS. 1, 2 and 4-6, designated herein by reference numeral 400. The apparatus 400 is substantially similar to the apparatus 100, 200, 300 and 350 described above. However, the apparatus 400 demonstrates that the coupler members 130 of the coupler 110 may expand rather than contract when engaging a corresponding socket, receptacle or other component.

For example, the coupler members 130 of the apparatus 400 may have a disengaged orientation as depicted in FIG. 7 by solid lines, and an engaged orientation as depicted in FIG. 7 by dashed lines. The apparatus 400 may also include more than one positioner 120, each of which may have disengaged and engaged orientations corresponding to those of the coupler members 130 (depicted in FIG. 7 by solid and dashed lines, respectively). Consequently, the transition of one or more of the positioners 120 from a first orientation towards a second orientation, such as in response to translation of the apparatus 400 towards a corresponding socket, receptacle or other component with which the apparatus 400 is being assembled, can cause the expansion of the coupler members 130 or other portions of the coupler 110, thereby engaging the apparatus 400 and the other component.

Figure 8:
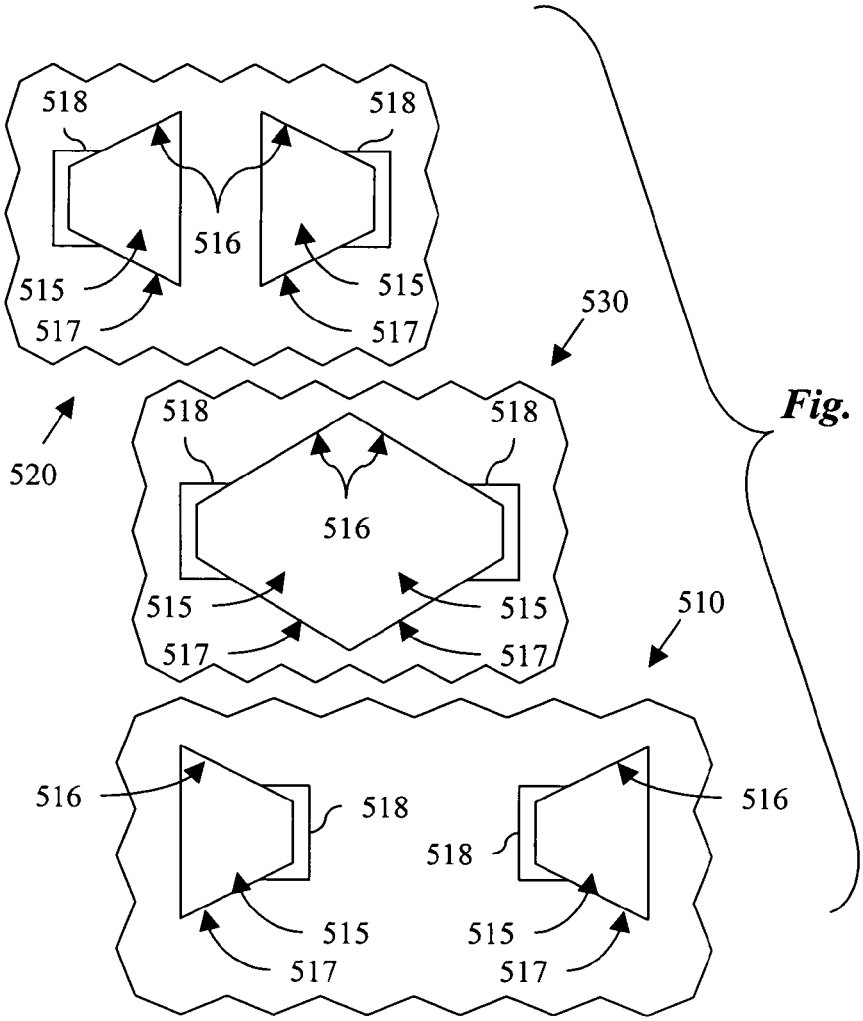
FIG. 8 is a schematic view of at least portions of several embodiments of apparatus according to aspects of the present disclosure.

Referring to FIG. 8, illustrated is a schematic view of at least a portion of several embodiments of the component 160 described above, designated herein by reference numerals 510, 520 and 530. The component 510 is substantially similar to the component 160 shown in FIGS. 3, 5 and 6, and includes openings or apertures 515 each configured to receive a coupler member 130. Each aperture 515 may extend partially or completely through the component 510. Engaging portions 517 of each aperture 515 may also have a tapered or other shape configured to encourage the alignment, mating and/or engaging of the coupler members 130 and the component 510.

In one embodiment, the component 510 may include a conductive portion 518 adjacent one or more of the apertures 515. The conductive portion 518 may comprise gold, silver, copper, alloys thereof and/or other conductive materials, which may be deposited on the component 510 by chemical-vapor-deposition, among other possible deposition processes. The conductive portion 518 may also be a conductive foil or other film adhered or bonded to the component 510. The conductive portion 518 may be located on a substantially planar surface of the component 510, thus creating additional thickness of the component 510, or may be located in a recessed portion such that the outer surface of the conductive portion 518 and the surrounding portion of the component 510 are substantially coplanar. The conductive portion 518 may also extend into one or more of the apertures 515, along one or more of the walls 516 of the aperture 515.

The component 510 is configured to engage with the coupler members 130 or other portions of the coupler 110 described above in response to contraction of the coupler members 130 (or portions of the coupler 110). In contrast, the components 520 and 530 are configured to engage with the coupler members 130 or other portions of the coupler 110 in response to expansion of the coupler members 130. Thus, the component 520 is substantially similar to the component 510 except for a reversed orientation of the apertures 515. The component 530 is substantially similar to the component 520 except that the apertures 515 of the component 520 are combined as a single aperture 515 in the component 530.

Figure 9:
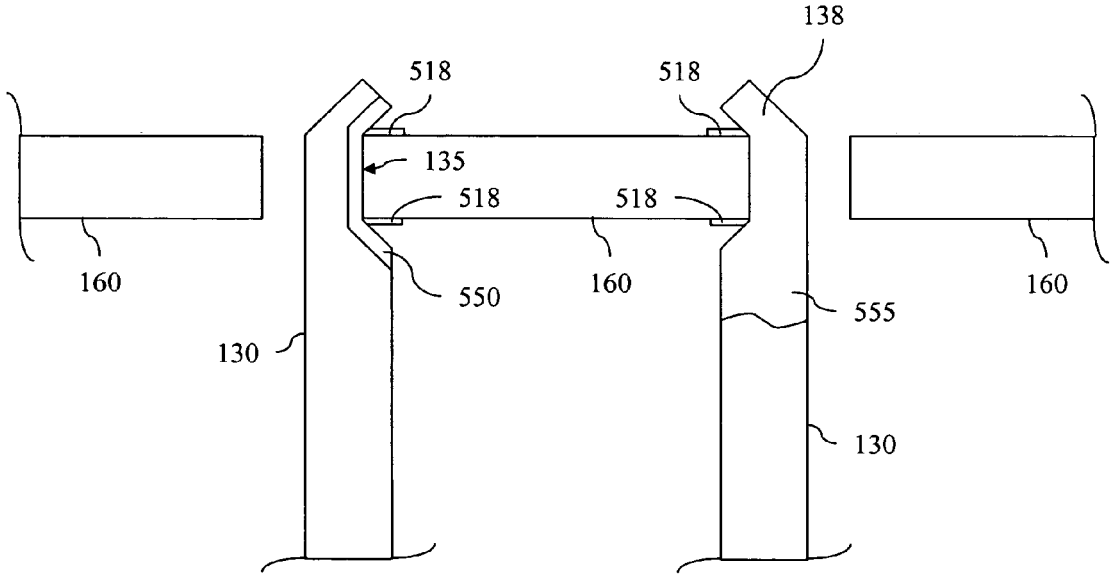
FIG. 9 is a schematic view of another embodiment of a portion of the apparatus shown in FIGS. 1 and 2.

Referring to FIG. 9, illustrated is a schematic view of at least a portion of an embodiment of the coupler members 130 described above in which the coupler members 130 include conductive portions configured to contact conductive portions 518 of a corresponding component 160, such as in embodiments in which the component 160 is substantially similar to the component 510 shown in FIG. 8. One of the coupler members 130 includes a conductive portion 550 substantially conforming to a profile 135 of the coupler member 130. The conductive portion 550 may be substantially similar in composition and manufacture to the conductive portions 518 described with respect to FIG. 8. Another of the coupler members 130 includes a conductive portion 555 substantially coating a substantial portion of the tip 138 of the coupler member 130. Such conductive portion 555 may be formed by dipping the coupler member 130 in a conductive material. In embodiments other than as illustrated in FIG. 9, each coupler member 130 may include substantially similar conductive portion configurations, such as either that of conductive portion 550 or that of conductive portion 555, although other configurations are also within the scope of the present disclosure.

The conductive portions 518 of the components 160, 510, 520 and 530 described above and the conductive portions 550 and 555 of the coupler members 130 may be configured to cooperate to establish electrical conductivity between the coupler members 130 and the component 160 (etc.) when such are engaged. Consequently, an electrical bias, current or signal may be passed through a series of assembled components. The apparatus 100, 200, 300, 350, 400 and the components 160, 510, 520 and 530 may also include electrical traces for assisting in such interconnectivity thereof.

Figure 10:
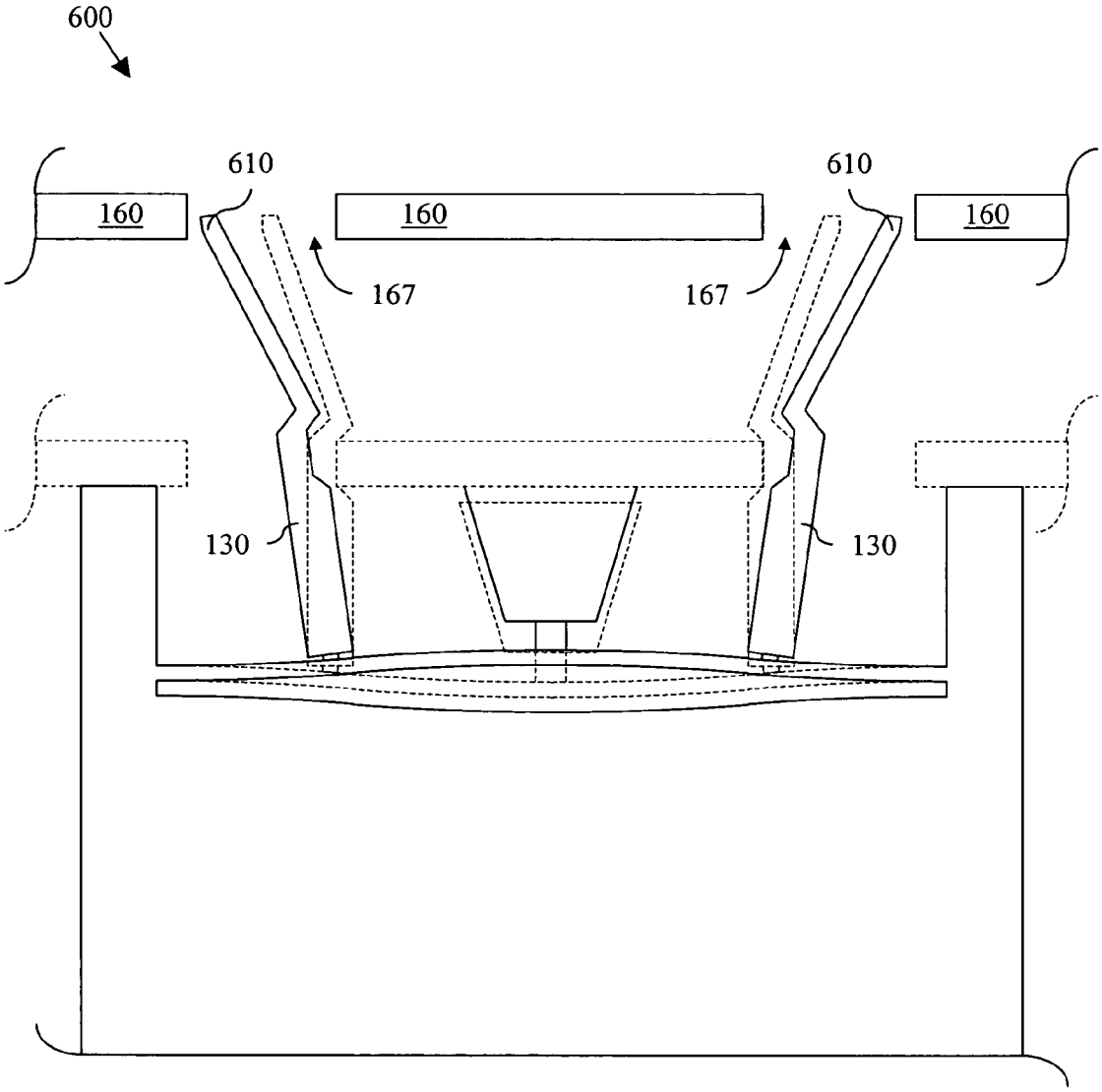
FIG. 10 is a schematic view of at least a portion of another embodiment of the apparatus shown in FIGS. 1 and 2.

Referring to FIG. 10, illustrated is a schematic view of at least a portion of another embodiment of the apparatus 100 (et al.) described above, herein designated by reference numeral 600. The apparatus 600 is substantially similar to the apparatus 100 and others described above, but also includes elongated guides 610 extending from each coupler member 130. The guides 610 may each be unitarily formed with a corresponding coupler member 130, and may aid in the alignment of the apparatus 600 with a component 160 during their assembly.

Thus, prior to the engagement of the apparatus 600 and the component 160, as depicted by the solid lines in FIG. 10, the guides 610 may be initially positioned in or proximate apertures 167 extending through the component 160. Subsequently, the separation between the apparatus 600 and the component 160 is decreased, such that the guides 610 pass through the apertures 167 to maintain alignment of the apparatus 600 and the component 160 while also causing the transition of the positioner 120 towards a different orientation and, ultimately, the subsequent engagement between the coupler members 130 and the component 160.

Once engaged, as depicted by the dashed lines in FIG. 10, the guides 610 may extend well past the component 160. The guides 610 may thereafter provide a more accessible interface for disengaging the component 160 from the apparatus 600. For example, the exertion of an expanding force to the tips of the guides 610 may urge the positioner 120 back towards its initial orientation or otherwise urge the coupler members 130 in opposing, outward directions, thus releasing the component 160 from the coupler members 130.

Figure 11:
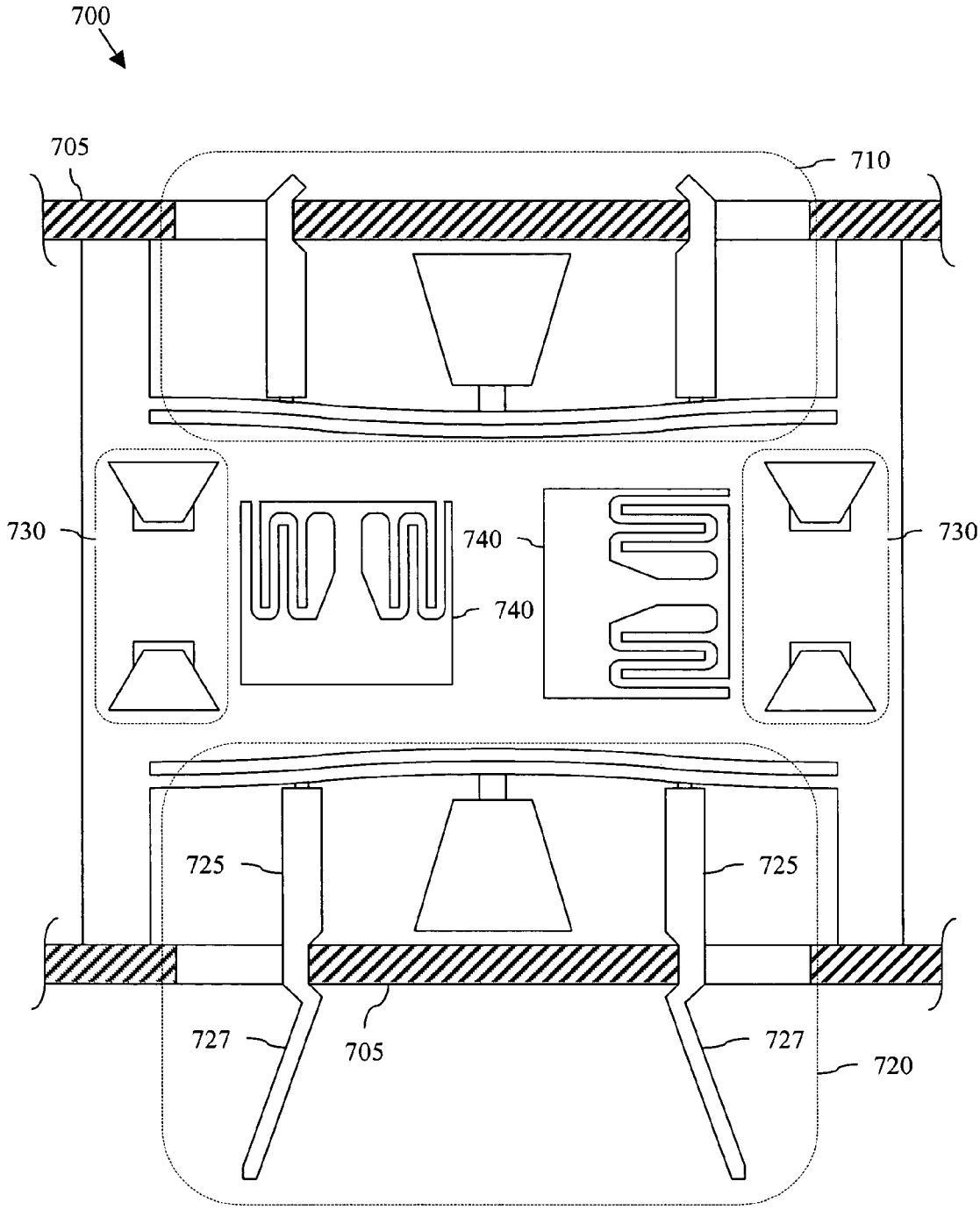
FIG. 11 is a schematic view of at least a portion of another embodiment of the apparatus shown in FIGS. 1 and 2.

Referring to FIG. 11, illustrated is a schematic view of one embodiment of an apparatus 700 according to aspects of the present disclosure, in which aspects of the apparatus 100, 200, 300, 350, 400 and 600 and/or the components 160, 510, 520 and 530 may be implemented in a single embodiment. For example, the apparatus 700 includes a coupler 710 which is substantially similar to the coupler 110 of the apparatus 100 shown in FIG. 1. The apparatus 700 also includes a coupler 720 having coupler members 725 each including guides 727 that are substantially similar to the coupler member guides 610 of the apparatus 600 shown in FIG. 10. The couplers 710 and 720 are each employed in the apparatus 700 to engage with corresponding components 705, each of which may be substantially similar to the component 160 shown in FIGS. 3, 5, 6, and/or 9 and/or one or more of the components 510, 520 and 530 shown in FIG. 8.

The apparatus 700 also includes receptacle pairs 730, each of which may be substantially similar to those of the receptacle 510 shown in FIG. 9. The apparatus 700 also includes two manipulation interfaces 740, each of which are substantially similar to the manipulation interface 210 shown in FIG. 4. One of the manipulation interfaces 740 is rotated 90 degrees relative to the other interface 740, although other configurations are within the scope of the present disclosure.

The apparatus 700 is presented herein to demonstrate that various of the aspects described above may be combined to provide various configurations of microcomponents and nanocomponents to assemble myriad different microassemblies and nanoassemblies. Moreover, such assembly may be in series and/or in parallel within the scope of the present disclosure. Such assembly may also be partially or substantially automated, including to the extent that the apparatus and components described above may be employed in a self-assembling system.

Figure 12:
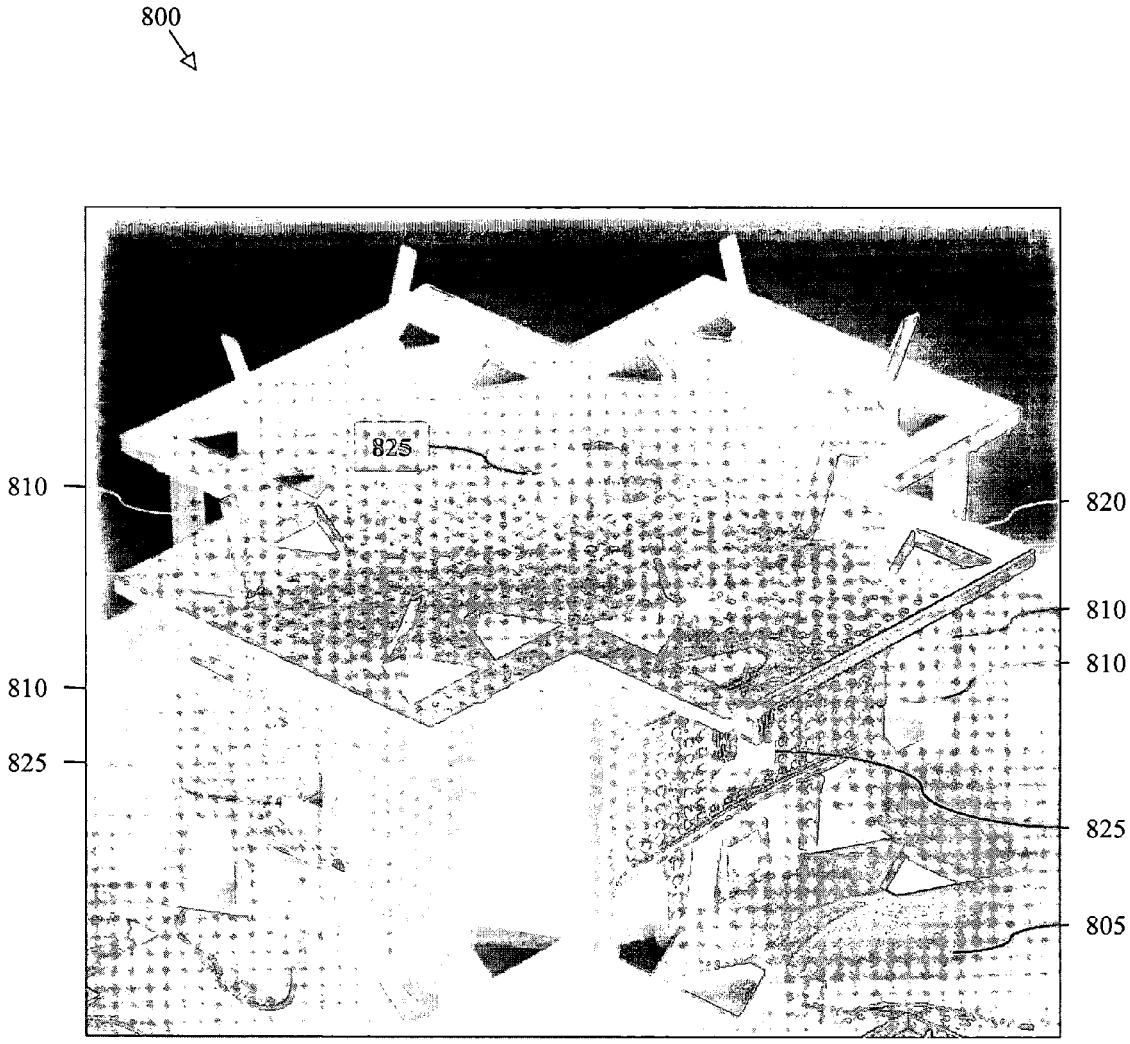
FIG. 12 is a perspective view of at least a portion of an embodiment of an assembly according to aspects of the present disclosure.

One such assembly according to aspects of the present disclosure is schematically depicted in FIG. 12 and designated herein by reference numeral 800. The assembly 800 includes four instances of a component 810, where aspects of each component 810 may be substantially similar to aspects of one or more of the apparatus 100, 200, 300, 350, 400, 600 and 700 described above. The assembly 800 also includes a component 820 having aspects that may be substantially similar to aspects of one or more of the components 160, 510, 520 and 530 described above.

In other embodiments having aspects similar to the embodiment illustrated in FIG. 12, one or more of the components 810 and 820 may have aspects that are substantially similar to aspects of one of the apparatus 100, 200, 300, 350, 400, 600 and 700 described above as well as aspects that are substantially similar to aspects of one of the components 160, 510, 520 and 530 described above. Thus, one or more of such components of such embodiments may include the active portion of the above-described coupler-receptacle pairings described above, as well as the passive portion of the above-described coupler-receptacle pairings described above. Such a component would have aspects similar to the apparatus 700 shown in FIG. 11. Consequently, in an assembly including one or more such components, each such component could both couple to a second component and be engaged by a coupler portion of a third component. Moreover, several of the components in such an assembly could be substantially identical. In fact, in one embodiment each component in the assembly could be substantially identical.

However, in the embodiment illustrated in FIG. 12, each component 810 includes a coupler configured to engage with a portion of a common substrate 805 where, at least in the illustrated embodiment, the coupler of each component 810 includes coupler members and guides similar to the coupler members 130 and guides 610 shown in FIG. 10. Each component 810 also includes similar coupler members and guides configured to engage with corresponding portions of the component 820. The components 810 and 820 each also include a manipulation interface 825 that may be substantially similar to the interface 210 shown in FIG. 4.

In one embodiment, each component 810 may be assembled to the substrate 805 by appropriately orienting the component 810 relative to one or more receptacles of the substrate 805, such as by manipulating an assembly probe frictionally engaged by the manipulation interface 825 of the component 810. Each component 810 may then engage with the substrate 805 by translating the component 810 towards the substrate which, as described above, may cause the transition of corresponding couplers and transitioners as appropriate to engage such couplers with corresponding portions of the substrate 805. The components 810 may be thus assembled to the substrate 805, whether in series or in parallel.

After each component 810 has been assembled to the substrate 805 (or before, or substantially simultaneously), the component 820 may be assembled to each of the components 810 by appropriately orienting the component 820 relative to the couplers/guides of each component 810, again by manipulation via the assembly probe now frictionally engaged by the manipulation interface 825 of the component 820. Upon alignment of the component 820 with the components 810, such as by the positioning of the guides of each component 810 with corresponding apertures of the component 820, the translation of the component 820 closer to the components 810 will ultimately cause the couplers/coupler members of each component 810 to engage with a corresponding portion of the component 820.

In one embodiment, each of the components 810 may not be necessary to support the component 820 in the general position illustrated in FIG. 12. However, in other embodiments, each of the four components 810 may be included because, e.g., aspects of such embodiments may possibly improve the accuracy of the position and orientation of the component 820 relative to the substrate 805. That is, the intricacies of etching and other silicon processing techniques can sometimes limit the accuracy, precision, repeatability, and other dimensional characteristics of components formed thereby. However, such limitations can be offset, decreased and/or overcome by some aspects of some embodiments of the present disclosure, possibly including aspects of the embodiment illustrated in FIG. 12.

Taking all of the above into consideration, the present disclosure introduces an apparatus including a positioner transitional from a first positioner orientation towards a second positioner orientation and comprising a bistable member having a first substantially stable state corresponding to the first positioner orientation and a second substantially stable state corresponding to the second positioner orientation. The apparatus also includes a coupler transitional from a first coupler orientation towards a second coupler orientation in response to transition of the bistable-member.

An embodiment of a method introduced in the present disclosure includes contacting a transitioner of a first microcomponent and a receptacle of a second microcomponent, and translating the first microcomponent towards the receptacle, thereby transitioning a coupler of the first microcomponent towards an engaged orientation in which the coupler and the receptacle are engaged. The coupler and the transitioner are each at least indirectly coupled to a positioner comprising a bistable member having at least one substantially stable state corresponding to the engaged orientation of the coupler.

The foregoing has outlined features of several embodiments so that those skilled in the art may better understand the general scope and detailed content of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. An apparatus, comprising:

a positioner transitional from a first positioner orientation towards a second positioner orientation and comprising a bistable member having a first substantially stable state corresponding to the first positioner orientation and a second substantially stable state corresponding to the second positioner orientation;

a coupler transitional from a first coupler orientation towards a second coupler orientation in response to transition of the bistable-member; and a manipulation interface coupled to the positioner and including at least one flexible member configured to deflect in response to contact with a manipulation probe and thereby frictionally engage the manipulation probe.

2. The apparatus of claim 1 wherein at least one of the positioner and the coupler has at least one feature dimension that is not greater than about 1000 microns.

3. The apparatus of claim 1 wherein the first and second coupler orientations correspond to the first and second positioner orientations.

4. The apparatus of claim 1 wherein the coupler includes at least two members each having first and second member orientations corresponding to the first and second coupler orientations, respectively.

5. The apparatus of claim 1 wherein the coupler and the positioner are unitarily formed.

6. The apparatus of claim 1 wherein the coupler is directly coupled to the positioner.

7. The apparatus of claim 1 wherein the coupler is directly coupled to a bistable portion of the positioner.

8. The apparatus of claim 1 further comprising at least one support, wherein the coupler is configured to engage at least one receptacle corresponding to the coupler in response to transition of the coupler towards the second coupler orientation, and wherein the at least one support is configured to abut the at least one receptacle when the coupler and the at least one receptacle are engaged.

9. The apparatus of claim 1 further comprising at least one transitioner, wherein the coupler is configured to engage at least one receptacle corresponding to the coupler in response to transition of the coupler towards the second coupler orientation, and wherein the at least one transitioner is configured to contact the at least one receptacle and, thereby, transition the positioner towards the second positioner orientation in response to translation of the coupler towards the at least one receptacle.

10. The apparatus of claim 1 wherein a first one of the first and second coupler orientations is an engaged orientation in which the coupler is configured to engage a receptacle corresponding to the coupler, and wherein a second one of the first and second coupler orientations is a disengaged orientation in which the coupler and the receptacle are disengaged.

11. The apparatus of claim 3 further comprising the receptacle.

12. The apparatus of claim 1 wherein the coupler includes at least two members each having first and second member orientations corresponding to the first and second coupler orientations, respectively, wherein a first one of the first and second member orientations is an engaged orientation in which the first and second members are configured to cooperatively engage at least one receptacle corresponding to the first and second members, and wherein a second one of the first and second member orientations is a disengaged orientation in which the first and second members are cooperatively disengaged from the at least one receptacle.

13. The apparatus of claim 12 wherein transition of the positioner from the first positioner orientation towards the second positioner orientation transitions the first and second members towards the engaged orientation by decreasing a separation distance between the first and second coupler members.

14. The apparatus of claim 12 wherein transition of the positioner from the first positioner orientation towards the second positioner orientation transitions the first and second members towards the disengaged orientation by decreasing a separation distance between the first and second coupler members.

15. The apparatus of claim 12 wherein transition of the positioner from the first positioner orientation towards the second positioner orientation transitions the first and second members towards the engaged orientation by increasing a separation distance between the first and second coupler members.

16. The apparatus of claim 12 wherein transition of the positioner from the first positioner orientation towards the second positioner orientation transitions the first and second members towards the disengaged orientation by increasing a separation distance between the first and second coupler members.

17. The apparatus of claim 12 wherein at least one of the first and second members includes a guide by which the at least one of the first and second members at least partially aligns with a corresponding feature of the at least one receptacle.

18. The apparatus of claim 17 wherein the guide extends from the at least one of the first and second members.

19. The apparatus of claim 17 wherein the guide is configured to extend through an aperture of the at least one receptacle.

20. A method, comprising:

frictionally engaging a manipulation interface of a first microcomponent with a manipulation probe, wherein the manipulation interface includes at least one flexible member configured to deflect in response to contact with the manipulation probe and thereby frictionally engage the manipulation probe;

contacting a transitioner of the first microcomponent and a receptacle of a second microcomponent; and translating the first microcomponent towards the receptacle, thereby transitioning a coupler of the first microcomponent towards an engaged orientation in which the coupler and the receptacle are engaged;

wherein the manipulation interface, the coupler and the transitioner are each at least indirectly coupled to a positioner comprising a bistable member having at least one substantially stable state corresponding to the engaged orientation of the coupler.

21. The method of claim 20 further comprising aligning a guide extending from the first microcomponent with a corresponding alignment feature of the second microcomponent, wherein the alignment feature is an aperture of the receptacle.

22. The method of claim 20 further comprising disengaging the manipulation interface from the manipulation probe after transitioning the coupler of the first microcomponent towards the engaged orientation.

23. A microscale apparatus in which at least one feature dimension is not greater than about 1000 microns, comprising:

a bistable member transitional between first and second substantially stable states;

coupler members unitarily formed with the bistable member and transitional between engaged and disengaged orientations corresponding to the first and second substantially stable states, wherein the coupler members cooperatively engage a receptacle when in the engaged orientation and are disengaged from the receptacle when in the disengaged orientation, wherein transition of the coupler members from the disengaged orientation towards the engaged orientation decreases a separation distance between the coupler members, and wherein the coupler members each include a guide extending therefrom and configured to extend through a corresponding aperture of the receptacle;

a support unitarily formed with the bistable member and configured to abut the receptacle when the coupler members engage the receptacle;

a transitioner unitarily formed with the bistable member and configured to contact the receptacle and, thereby, transition the bistable member from the second substantially stable state towards the first substantially stable state in response to translation of the coupler towards the receptacle; and a manipulation interface unitarily formed with the bistable member and including an opposing pair of flexible members configured to deflect in response to contact with a manipulation probe and thereby frictionally engage the manipulation probe.

* * * * *